US006111232A

United States Patent [19]

Kleinfeld

[11] Patent Number: 6,111,232

[45] Date of Patent: Aug. 29, 2000

[54] RECOVERY BOILER SMELT SPOUT

[75] Inventor: Jack M. Kleinfeld, Bronx, N.Y.

[73] Assignee: Champion International Corporation, Stamford, Conn.

[21] Appl. No.: 09/044,348

[22] Filed: Mar. 19, 1998

Related U.S. Application Data

[60] Division of application No. 08/852,727, May 7, 1997, Pat. No. 5,783,140, which is a continuation-in-part of application No. 08/507,029, Sep. 1, 1995, Pat. No. 5,635,095.

[51] Int. Cl.[7] ..... H05B 3/06; F24H 1/10

[52] U.S. Cl. ..... 219/523; 392/489

[58] Field of Search ..... 219/523, 520; 222/590; 392/489

[56] References Cited

U.S. PATENT DOCUMENTS

| | | | |
|---|---|---|---|
| 4,812,626 | 3/1989 | Strada | 219/523 |
| 4,882,470 | 11/1989 | Zenbayashi et al. | 219/523 |
| 4,897,529 | 1/1990 | Haga et al. | 219/534 |
| 4,900,897 | 2/1990 | Cunningham et al. | 219/336 |
| 4,983,813 | 1/1991 | Van Tulleken et al. | 219/523 |
| 5,109,473 | 4/1992 | Rezabek et al. | 392/497 |
| 5,113,057 | 5/1992 | Tsai | 219/523 |
| 5,136,143 | 8/1992 | Kutner et al. | 219/544 |
| 5,389,763 | 2/1995 | Nagan et al. | 219/221 |
| 5,400,636 | 3/1995 | Bailey | 72/370 |
| 5,635,095 | 6/1997 | Kleinfeld | 222/590 |
| 5,850,073 | 12/1998 | Eckert | 219/523 |
| 5,859,953 | 1/1999 | Nickless | 392/489 |

*Primary Examiner*—Teresa Walberg
*Assistant Examiner*—Daniel Robinson

[57] ABSTRACT

A heating element comprising:

a body having a heating section;

heating means inserted in or adjacent to said body, said means capable of generating heat, having a heat flux $Q_1$ at a temperature $T_1$; and heat transfer and concentration means capable of transferring said heat from said heating means to said heating section and concentrating said heat in said section such that said section has a heat flux $Q_2$ at a temperature of $T_2$, where $Q_2$ is greater than $Q_1$ and where $T_2$ is equal to or less than $T_1$.

25 Claims, 5 Drawing Sheets

RECOVERY BOILER SMELT SPOUT

RELATED APPLICATIONS

This application is a divisional of Ser. No. 08/852,727 filed May 7, 1997 of U.S. Pat. No. 5,783,140 which in turn is a continuation-in-part of Ser. No. 08/507,029 filed Sep. 1, 1995 of U.S. Pat. No. 5,635,095.

BACKGROUND OF THE INVENTION

1. Field of the Invention

The present invention relates to an improved heating element which can be used in a process of the type in which a molten material at elevated temperature is poured or dispensed from a container, vessel or the like, as for example a recovery boiler in a wood pulping process, where there is a tendency for the material to freeze or block the outlet of the container, vessel or the like during operation or shutdown of the process. In particular, the invention is directed to a heating element for use in a method of shutting down and starting up, or correcting a freeze up of the process.

2. Description of the Prior Art

Processes are known in which a molten material is discharged from a vessel via some outlet. Illustrative of such processes are those for processing molten metals or metal alloys such as steel, iron, nickel and the like and for processing molten polymers such as polyesters, polycarbonates, polyamides and the like.

Such processes also include the recovery process in pulp mills. Pursuant to present-day pulp mill operations, raw wood is delignified by a thermo-chemical process comprising an approximately 350° F. cook in the presence of sodium hydroxide, sodium carbonate, sodium sulfide and other sodium based compounds. Under such conditions, the lignin binder in the raw wood matrix which holds the natural cellulose fibers together reacts with the sodium and sulfur compounds to form water soluble lignin-sodium complexes thereby permitting a water wash separation of the black tar-like lignin from the fiber for manufacture of paper or other cellulose materials.

Although the sodium compounds used in the afore-described process are relatively inexpensive, the quantities consumed in the production of an average pulp mill necessitate an economical recovery and recycle of the chemical values. Moreover, such sodium-lignin complexes contain sufficient heat value to contribute favorably to the overall mill heat balance. These characteristics are combined in the liquor recovery furnace by fueling a boiler furnace with a concentrated flow stream of the spent or black pulping liquor. Residual ash, predominately sodium carbonate and sodium sulfide falls to the furnace bed as a viscous smelt. Such smelt is removed from the furnace, shattered and dissolved in water to form the green liquor makeup stream from which the other fresh cooking liquor compounds are made.

In transition from the furnace bed to a green liquor dissolving tank, smelt flows in thin continuous streams from numerous spouts around the furnace bed perimeter. Such smelt streams fall directly into the dissolving tank. The smelt typically has a temperature of from about 800° F. to about 1800° F. as it is discharged from the recovery boiler. It is not possible to let this molten stream pour directly into the aqueous solution of the dissolving tank as this would cause a violent explosive reaction. To prevent or minimize violent reaction as the smelt combines with the aqueous green liquor, the smelt spout streams are shattered into small particles as for example by dispersion jets of steam.

A similar problem exists in start-up of a shutdown recovery boiler and during process upset when the smelt in the smelt spout is accidentally or deliberately frozen. During shutdown, the temperature of the boiler is below normal operational temperature and as low as ambient temperature which results in the solidification of smelt in the bottom of the recovery boiler and in the recovery boiler smelt spout. On start-up or during process upset means must be provided to melt the frozen smelt in the spout to return it to operation. In the past, three methods have been used, each having disadvantages.

One method is to melt the smelt in the spout through use of a portable gas burner. This method has the disadvantage of a lack of convenience in the need for a gas supply and fuel supply equipment such as a vaporizer. This method is also time consuming in that the gas burner may have to be assembled and conveyed to the boiler for use.

In the other prior art methods, a rod is used. For example, in one method a metal rod is driven into the frozen smelt to unplug the spout. In the other method, a metal rod is placed in the spout prior to shutdown or upset and is withdrawn prior to start-up to provide an opening to the furnace. These methods also have disadvantages. For example, driving the rod into the frozen smelt often causes damage to the boiler and personal injury to the operator, and is time consuming and may require many hours, i.e., 8 hours or more, to open the spout. In the other method, the rod is often fixed in the frozen smelt and cannot be withdrawn. Each of these methods suffer from the added disadvantage of explosive reaction between the molten smelt and the water on start-up or unpluggage of a frozen smelt spout of a furnace in operation. Normally, as the recovery boiler is started up, the smelt in the bottom of the furnace melts sooner than the smelt plugging the smelt pour spout. Similarly, when the spout is unplugged after an upset, the smelt in the bottom of the furnace is in a molten state. In either case, when the spout is finally opened, a heavy flow of smelt into the water may occur with violent and explosive reaction resulting.

This invention obviates many disadvantages of the prior art processes. For example, this invention reduces the likelihood of a heavy flow of smelt into the water causing a violent and explosive reaction. This invention also provides for greater protection against damage to the boiler and increased speed of freeing a frozen spout as compared to the rod and gas burner methods. The present invention also provides for freedom from gas supply and fuel supply equipment difficulties attendant to the use of gas burner method, and is more reliable than the rod method for keeping a spout open through a shutdown for easy and safe start-up.

SUMMARY OF THE INVENTION

One aspect of this invention relates to a heating element comprising:

- a body having a heating section, preferably at or near an end of the body;
- heating means inserted in or positioned adjacent said body, said means having a heat flux $Q_1$ and capable of generating a temperature $T_1$;
- heat transfer and concentration means capable of transferring heat from said heating means and concentrating said heat in said heating section such that said heating section has a heat flux $Q_2$ where $Q_2$ is greater than $Q_1$ and a temperature of $T_2$ where $T_2$ is equal to or less than $T_1$.

The heating element of this invention is especially useful for opening the outlet of a vessel in which a material has frozen in the outlet. When used in this manner, the heating section is formed from a substance having a melting point which is greater than the melting point of the material. Moreover, $T_2$ is equal to or greater than the melting point of the material.

Another aspect of this invention relates to a method for shutting down and starting up a process for forming a hot molten material in a vessel, and discharging said molten material from discharge outlet of said vessel, said method comprising:

inserting heating element of this invention into said outlet;

cooling down said material in said vessel and said outlet to solidify said material such that said heating section of said element is fixed in said solidified material in said outlet; and starting up said process by heating said heating section of said element to a temperature equal to or greater than the melting point of said solidified material to melt said solidified material in said outlet and removing said element from said outlet to provide a substantially open outlet for discharge of said molten material from said vessel.

Still another aspect of this invention relates to a method for shutting down and starting up a chemical recovery process in which a concentrated black liquor is burned in a furnace to produce a gas and a hot molten smelt in the bottom of said furnace and the hot molten smelt is discharged from said furnace via a smelt spout, said method comprising:

inserting the heating section of the heating element of this invention into said spout;

shutting down said furnace with said heating section of said element in said spout such that on solidification of molten smelt in said spout said element is fixed in said solidified smelt; and starting up said furnace by heating said heating section of said element to a temperature equal to or greater than the melting point of said solidified smelt to melt said smelt solidified in said spout and removing said element from said spout to provide a substantially open spout for discharge of said molten smelt from said furnace.

Yet another aspect of this invention relates to a method for opening a discharge outlet of a vessel for use in forming a molten material in said vessel, and discharging said molten material from said vessel via said outlet wherein a material has solidified in said outlet preventing the discharge of material from said vessel, said method comprising:

heating said material solidified in said outlet with the heating section of the heating element of this invention, said heating section having a melting point which is greater than the melting point of said material, said heating section heated to a temperature equal to or greater than the melting point of said material solidified in said outlet but less than the melting point of said heating section, said material solidified in said outlet heated for a time sufficient for a flow of heat from said heating section to said solidified material sufficient to melt said solidified material to provide a substantially open discharge outlet for discharge of said molten material from said vessel.

Still another aspect of this invention relates to a method for opening a smelt spout of a furnace used in a chemical recovery process in which a concentrated black liquor is burned in the furnace to produce a gas and a hot molten smelt in the bottom of said furnace and the hot molten smelt is discharged from said furnace via a smelt spout where said smelt has solidified in said spout to prevent the discharge of smelt from said furnace, said method comprising:

heating said smelt solidified in said spout with a heating section of the heating element of this invention, said heating section having a melting point which is greater than the melting point of said smelt, said heating section heated to a temperature equal to or greater than the melting point of said smelt solidified in said spout but less than the melting point of said heating section, said smelt solidified in said spout heated for a time sufficient for a flow of heat from said heating section to said solidified smelt sufficient to melt said solidified smelt to provide a substantially open spout for discharge of said smelt from said furnace.

BRIEF DESCRIPTION OF THE DRAWINGS

In the following description of a preferred embodiment of this invention, reference will be made to the accompanying drawings, in which.

DETAILED DESCRIPTION OF THE INVENTION

Figure 1:
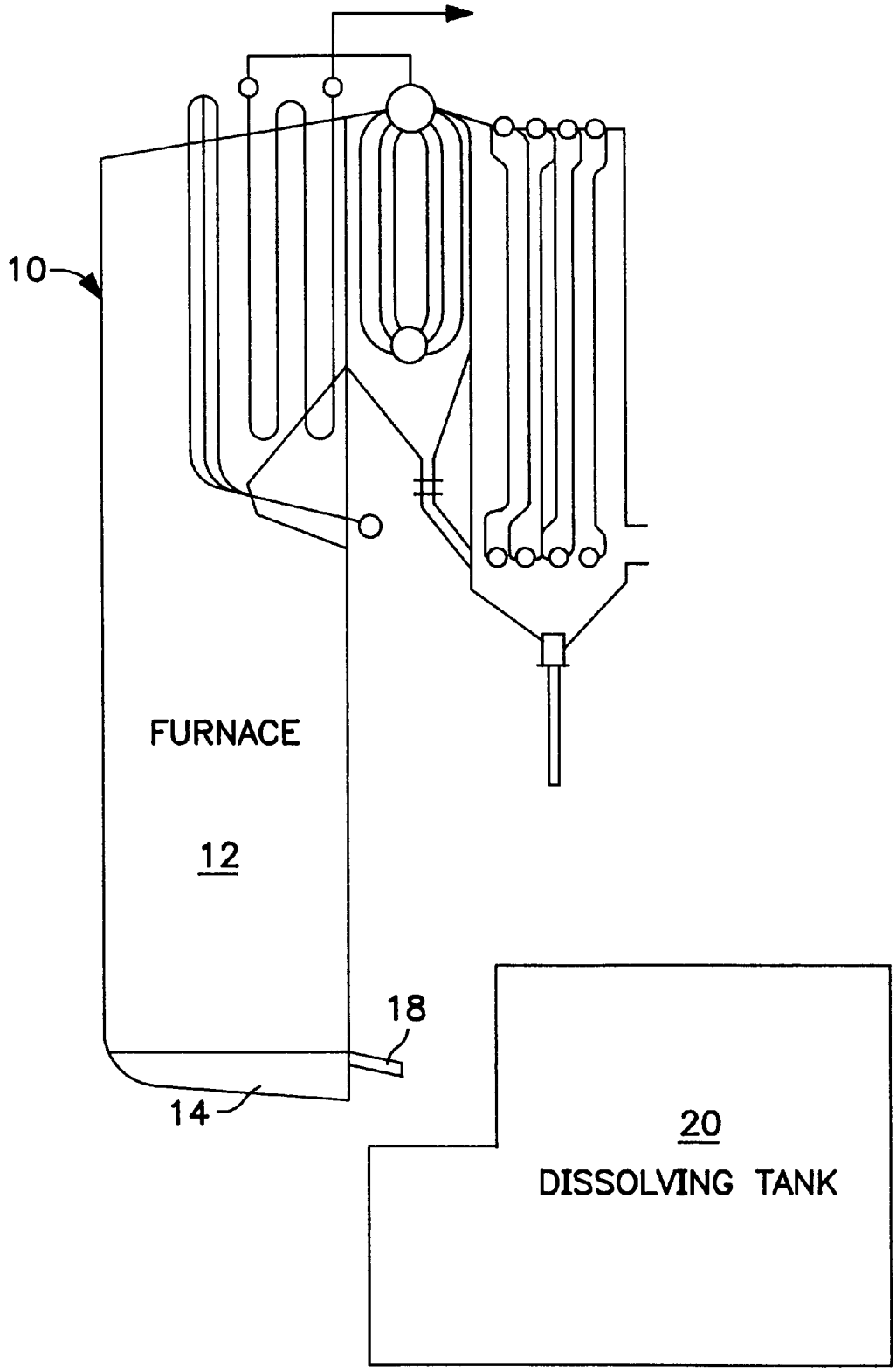
FIG. 1 is a partially schematic view of a typical recovery boiler and shows the location of the smelt pour spout and the smelt dissolving tank.

Referring to FIG. 1, the numeral 10 denotes generally a recovery boiler used in pulp making and the numeral 20 denotes a soda dissolving tank. Boiler 10 includes a furnace 12 which contains a quantity of smelt 14 at its bottom and a smelt pour spout 18 for discharging molten smelt 14 from furnace 12. The remainder of the furnace 12 contains fumes. During operation of the furnace 12, the smelt 14 and fumes are at elevated temperatures. During shut down status, the fumes are condensed and the smelt 14 solidifies to a solid state. Dissolving tank 20 contains an aqueous solution, usually made with weak white liquor or weak liquor from the causticizing plant. During operation of the recovery boiler 10, thin streams of molten smelt 14 are discharged from furnace 12 via smelt pour spout 18, whereafter the smelt 14 under free fall falls downward into dissolving tank 20 usually after treatment with some means (not depicted) to break up the continuous smelt streams into fine particles. The details of the construction of the recovery boiler 10 and dissolving tank 20 are disclosed for background purposes in explaining this invention and are not part of this invention.

The preferred embodiments of the present invention relate to an improved heating element for use in a process for shutting down and starting up a recovery boiler, and a process for freeing smelt pour spouts of recovery boilers intentionally or accidentally frozen during operation. Concentrated black liquor is introduced into an upper portion of furnace 12 where it is converted into low BTU gaseous fumes and reduced smelt 14 by partial oxidation with air. Typically furnace 12 is operated at elevated temperature.

Figure 3:
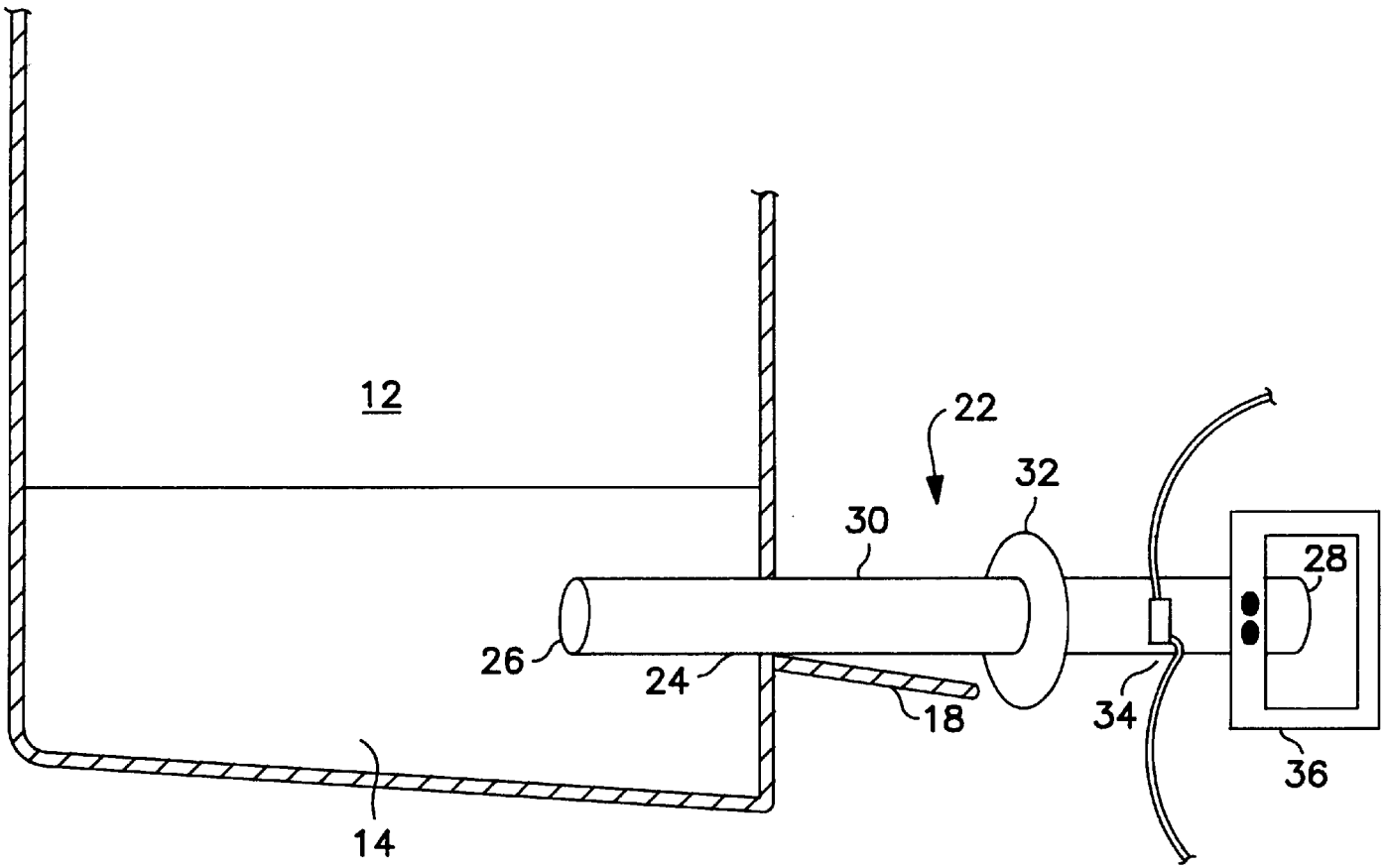
FIG. 3 is an enlarged cross-sectional view of a smelt pour spout of a recovery boiler in a shut-down status with a heating element of this invention inserted therein.

Inorganic components of the black liquor are melted to form smelt 14 which is discharged from the bottom of furnace 12. through spout 18 into dissolving tank 20. During shut down, the furnace is turned off and smelt 14 remaining in the furnace 12 and in spout 18 begins to solidify. A preferred embodiment of this invention for shutting down and starting up a furnace is depicted in FIG. 3. As shown in FIG. 3, at some point in time prior to shut down to some point after shut down but prior to solidification of the smelt, elongated heating element 22 is inserted into spout 18 and left in place during shut down. Preparatory to start-up of furnace 12, heating element 22 is heated to temperature sufficiently high to allow removal of heating element 22 from spout 18, usually a temperature equal to or greater than the melting point of the smelt, to provide an open spout 18 for safe start-up of boiler 10 and thereby prevent or reduce explosive discharge of melted smelt 14 from furnace 12 into tank 20.

Figure 4:
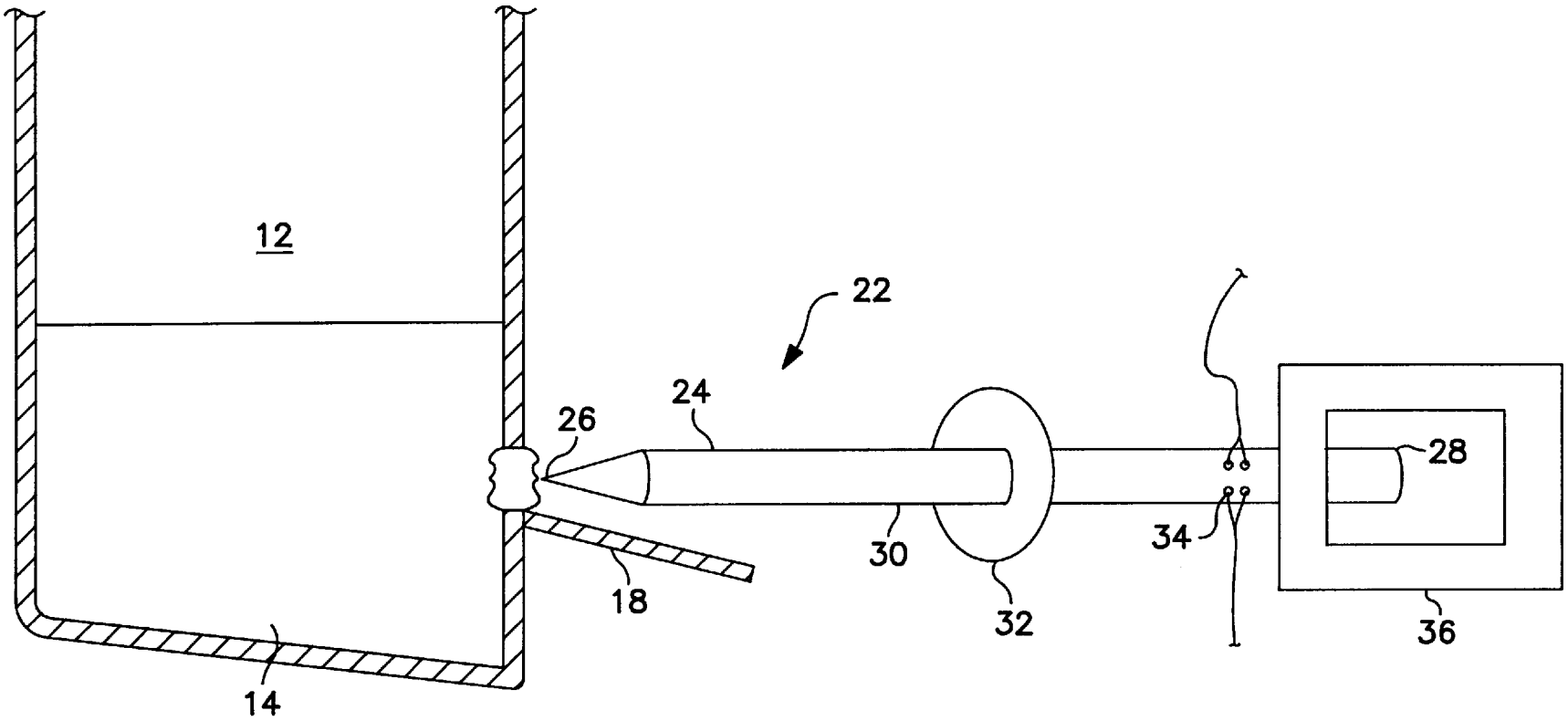
FIG. 4 is an enlarged cross-sectional view of a frozen smelt pour spout of a recovery boiler having a heating element of this invention applied thereto.

A preferred embodiment of this invention for unfreezing a frozen smelt spout, as for example a spout which is intentionally or accidentally frozen during operation or frozen during shut down, is depicted in FIG. 4. As depicted in FIG. 4, heating element 22 heated to a temperature equal to or greater than the melting point of the smelt is applied through use of some suitable application technique, for example manually, mechanically or automatically, to the smelt for a time sufficient to free the frozen smelt spout 18 to the desired extent. Thus, molten smelt 14 in furnace 12 is then free to flow from furnace 12 in a continuous variable flow and does not exit spout 18 in a heavy flow to react violently and explosively with water in tank 20.

Heating element 22 comprises a heating section at or near one end for application of heat to the material or smelt. The shape and configuration of the heating section may vary widely. For example, the end of heating section may blunt, flat, conical, hemispherical and the like. The heating section itself may be of any shape, as for example spherical, conical, rectangular and the like. The heating section may be of the same cross-section or diameter as the remaining sections of the element 22. Preferably, the heating section at the end of the element 22 is of a larger cross-section than the remaining body of the device in which the larger cross-section heating section is co-axial or offset from the axis of the remaining body of element 22. This configuration reduces the contact area of the body of element 22 with the opening of spout 18 as element 22 is contacted with the opening and is advanced through the opening. This configuration also reduces the heat load, mechanical drag or force required to use heating element 22 for its intended use and any interactions between element 22 and the surroundings. Where the cross section of the remaining portion of the body is reduced, the remaining portion of the body can be insulated to reduce heat load and also to allow use of external heat sources, as for example a heating jacket adjacent to and in contact with the reduced cross-sectional body of element 22.

The mode of operation of heating element 22 is critical. It is critical that element 22 include a heating section, a heating means and a heat transfer means. The heating means generates heat sufficient to melt the molten smelt, the heat transfer means transfers heat from the heating means to the heating section and the heating section applies heat to the solidified smelt.

Useful heating means may vary widely provided that it is capable of attaining a heat flux $Q_2$ and a temperature $T_1$ which is equal to or greater than the melting point of smelt 14. Heating means may be internal or external to the body of element 22. Illustrative of useful heating means are insertable cartridge heaters, external jacket heaters and the like.

The heat transfer means transfers sufficient heat to the heating section such that the heating section is capable of attaining a heat flux of $Q_2$ which is greater than $Q_1$ and a temperature $T_2$, which is equal to or less than $T_1$ and is equal to or greater than the melting point of smelt 14. Suitable heat concentrating means include heat transfer fluids suitable for the temperature of use such as liquid or vaporous potassium or sodium either alone or in combination with a metallic or ceramic wicking or absorption materials or the like. The size and shape of heating element 22 may vary widely. The only requirement is that the size and shape of heating element 22 are such that it can be inserted into smelt spout 18 and into the opening of spout 18. For example, the length of heating element 22 may vary widely. The length of heating element 22 can range from a length merely sufficient to pierce the opening of spout 18 to a length sufficient to penetrate the length of the opening of spout 18 and all or a portion of smelt 14 in the bottom of furnace 12. In the preferred embodiments of the invention, the length of heating element 22 is sufficient to penetrate the opening of spout 18 to reach the interior of furnace 14.

The cross-section of heating element 22 is not critical and may vary widely. For example, the heating element 22 may be of regular cross-section such as circular, rectangular, hexagonal and the like, or of irregular cross-section. Heating element 22 may also have a non-coaxial design. Heating element 22 may be of substantially uniform cross-section along its entire length or can be of non-uniform cross-section.

Heating element 22 may be of any configuration. For example, heating element 22 may be elongated, straight or curved. Moreover, heating element 22 may be angle component or composed of two or more components.

Heating element 22 includes means for heating element 22 to a suitable temperature, which means may be external or internal to element 22. Such means may vary widely and include means known to those of skill in the art such as electrical heating means, gas heating means, and the like. For example, heating means may be one or more electric calrods or cartridge heaters which are inserted into the body of heating element 22 or external jacket heaters.

Heating temperature may vary widely and should be sufficiently high to melt or soften the smelt or material. Preferably, the temperature is sufficient to melt the smelt and is at least about 800° F. The heating temperature is preferably from about 800° F. to about 2000° F., more preferably from about 900° F. to about 1800° F. and most preferably from about 1000° F. to about 1500° F.

The materials used to construct the smelt heating element 22, may vary widely and include metals, ceramics, metal alloys and the like. Element 22 is usually constructed from metal or a metal alloy. Element 22 is preferably constructed of a metal alloy which is resistant to temperature and the corrosivity of molten smelt 14.

Figure 2:
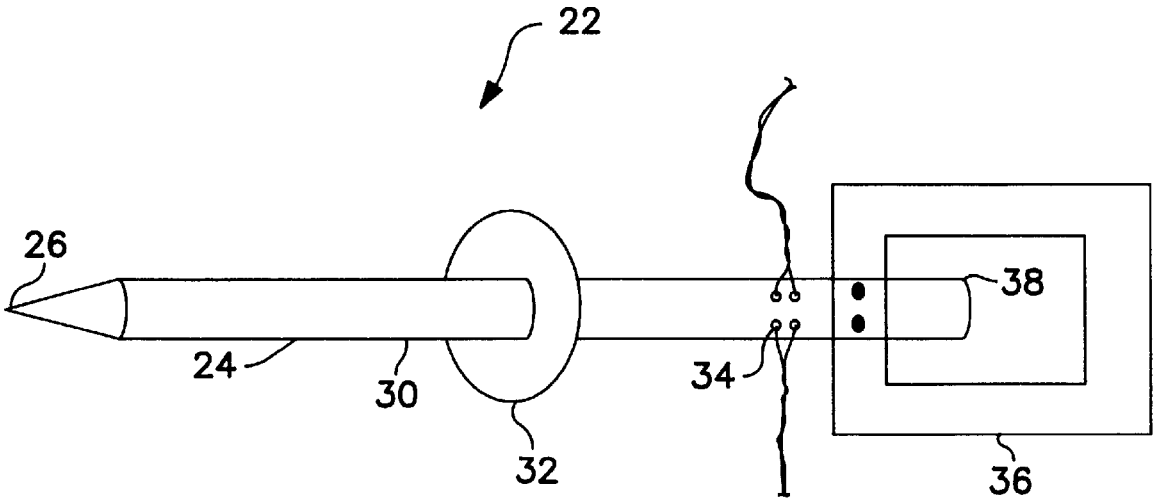
FIG. 2 is a sideview of a preferred heating element of this invention.

A preferred heating element 22 for use in the practice of this invention is depicted in FIG. 2. As depicted in FIG. 2, heating element 22 is a substantially straight heat pipe of substantially circular cross-section, having a length which is sufficient to allow insertion of heat pipe 22 into the opening of smelt spout 18, into the bottom of furnace 12. As depicted in FIG. 2, heat pipe 22 includes three sections. One section is insertion or heating section 24, which may be of any shape or configuration which extends from the in-board end 26 of pipe 22 to a point closer to the outboard end 28 of the pipe 22. Heat pipe 22 also includes intermediate section 30 which is fitted with an annular collar 32 to prevent molten smelt from running any further down the pipe 22. The remaining outboard section 28 of pipe 22 includes wells 34 for connection of electrical heating units in pipe 22 to a source of electricity (not depicted). Heating element 38 may also be fitted with an insulating sheath to reduce heat loss and to protect equipment and persons using the heating element. A handle 36 is connected to the end of outboard section 28 of pipe 22.

Figure 5:
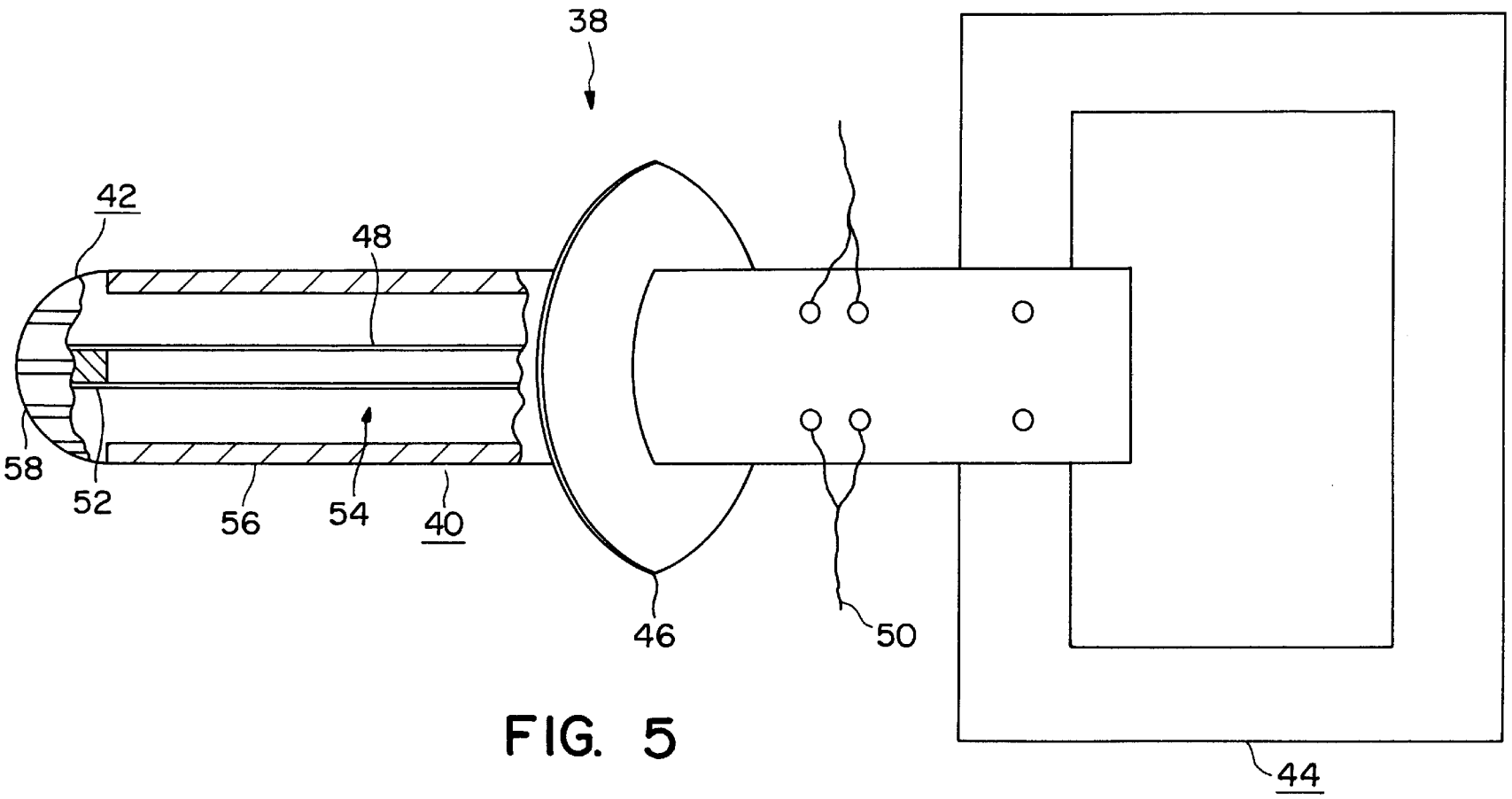
FIG. 5 is a cross-sectional view of a preferred heating element of this invention.

Another preferred heating element 38 is depicted in FIG. 5. As depicted in FIG. 5, heating element 38 includes three sections: body 40, heating section 42 and handle 44. Body 40, which in this preferred embodiment is a substantially straight body of substantially circular cross-section which is fitted with an annular collar 46. Body 40 also includes an internal heating element which is a cylindrical electrical cartridge heater 48 having external electrical connections 50 for connection of heater 48 to a source of electricity (not depicted). Heater 48 is capable of generating a heat flux $Q_1$ and a temperature $T_1$ which is equal to or greater than the melting point of smelt. Heater 48 is inserted into well 52 which is a cavity extending longitudinally into body 40.

Body 40 also includes heat transfer means 54 for transfer of heat from heater 48 to heating section 42 and concentrating heat in heating section 42 such that heating section 42 has a heat flux $Q_2$, where $Q_2$ is greater than $Q_1$, and a temperature of $T_2$ which is equal to or less than $T_1$ and equal to or greater than the melting point of smelt or material. Heating section 42 which is connected to the inboard end of body 40 is also of substantially circular cross-section and is of larger diameter than body 40. Section 42 includes gutters or flutes 58 which allow molten smelt to flow away from the spout opening. A handle 44 is connected to the outboard end of body 40. Body 40 also includes external insulation 56 to reduce heat loss.

Obviously, many modifications and variations of the present invention are possible in light of the above teachings. It is therefore to be understood that, within the scope of the appended claims, the invention may be practiced otherwise than as specifically described.

What is claimed:

1. A heating element for opening a discharge outlet of a vessel for containing a molten material in which said molten material has solidified in or about said outlet preventing or interfering with the discharge of molten material from said vessel or for maintaining open such discharge opening said element comprising:

a body comprising a heating section means, said heating section means for contacting said solidified molten material in said discharge outlet to supply heat thereto sufficient to melt all or a portion of said contacted solidified molten material to allow flow of molten material from said vessel;

heating means inserted in or positioned adjacent to said body for generating heat, said heating means capable of generating a heat flux $Q_1$, at a temperature $T_1$; and heat transfer and concentration means for transferring said heat from said heating means to said heating section means such that said heating section means has a heat flux $Q_2$ where $Q_2$ is greater than $Q_1$, and a temperature $T_2$ which is equal to or less than $T_1$.

2. Heating element of claim 1 wherein said heating element is electrically heated.

3. Heating element of claim 2 wherein said heating element is a heat pipe.

4. Heating element of claim 3 wherein said heat pipe further comprises a collar fitted about the outer surface thereof to prevent or retard the flow of molten smelt down said pipe.

5. Heating element of claim 3 wherein said heat pipe further comprises an interior space adjacent to the heating section of said pipe, said space having an electrical heater inserted therein.

6. Heating element of claim 1 wherein said heating section means has a larger cross-sectional area than a portion of said body immediately adjacent to said heating section.

7. Heating element of claim 3 wherein said heating section means has a larger cross-sectional area than a portion of said body immediately adjacent to said heating section.

8. Heating element of claim 6 wherein said heating element is of circular or substantially circular cross-section.

9. Heating element of claim 7 wherein said heat pipe is of circular or substantially circular cross-section.

10. Heating element of claim 8 wherein said heating section means is conical.

11. Heating element of claim 8 wherein said heating section means is conical.

12. Heating element of claim 10 wherein said heating section means comprises one or more gutters in a surface thereof extending toward the body of said heat dive to allow the flow of molten material in said gutters.

13. Heating element of claim 11 wherein said heating section means comprises one or more gutters in a surface thereof extending toward the body of said heat pipe to allow the flow of molten material in said gutters.

14. Heating element of claim 12 wherein said gutters are parallel or substantially parallel to the longitudinal axis of said heat pipe.

15. Heating element of claim 13 wherein said gutters are parallel or substantially parallel to the longitudinal axis of said heat pipe.

16. Heating element of claim 8 wherein said heat pipe further comprises insulation adjacent to said body to reduce heat loss.

17. Heating element of claim 9 wherein said heat pipe further comprises insulation adjacent to said body to reduce heat loss.

18. Heating element of claim 16 wherein said insulation is external of said body, is internal to said body or a combination thereof.

19. Heating element of claim 17 wherein said insulation is external to said body, internal to said body or a combination thereof.

20. A smelt spout opener for opening a smelt spout of a furnace used in a chemical recovery process in which concentrated black liquor is burned in the furnace to produce a gas and a hot molten smelt in the bottom of said furnace and the hot molten smelt is discharged from said furnace via a smelt spout where said smelt has solidified in or about said spout preventing or interfering with the discharge of molten smelt from furnace or for maintaining open such smelt spout, said smelt spout opener comprising:

a body having a heating section means for contacting said solidified smelt in or about said spout to supply heat thereto sufficient to melt all or a portion of said contacted solidified smelt to allow flow of said molten smelt from said furnace;

heating means inserted in or positioned adjacent to said body for generating heat, said heating means capable of generating a heat flux $Q_1$ at a temperature $T_1$; and heat transfer and concentration means for transferring said heat from said heating means to said heating section means such that said heating section means has a heat flux $Q_2$ where $Q_2$ is greater than $Q_1$ and a temperature $T_2$ which is equal to or less than $T_1$.

21. Smelt spout opener of claim 20 wherein said heating means is heated electrically.

22. Smelt spout opener of claim 21 wherein said body is elongated and said heating section means is at or about an end of said body.

23. A smelt spout opener for opening a smelt spout of a furnace used in a chemical recovery process in which concentrated black liquor is burned in the furnace to produce a gas and a hot molten smelt in the bottom of said furnace and the hot molten smelt is discharged from said furnace via a smelt spout where said smelt has solidified in or about said spout preventing or interfering with the discharge of molten smelt from furnace or for maintaining open such smelt spout, said smelt spout opener comprising:

a body having a heat application surface configured to contact said solidified smelt in or about said spout to supply heat thereto sufficient to melt all or a portion of said contacted solidified smelt to allow flow of said molten smelt from said furnace;

a heater inserted in or positioned adjacent to said body for generating heat, said heater configured to generate a heat flux $Q_2$ at a temperature $T_1$; and heat transfer and concentration element configured to transfer said heat from said heater to said heat application surface such that said heat application surface has a heat flux $Q_2$ where $Q_2$ is greater than $Q_1$ and a temperature $T_2$ which is equal to or less than $T_1$.

24. Smelt spout opener of claim 23 wherein said heater is heated electrically.

25. Smelt spout opener of claim 24 wherein said body is elongated and said heat application surface is at or about an end of said body.

* * * * *